United States Patent [19]

Courtney

[11] Patent Number: 4,645,465

[45] Date of Patent: Feb. 24, 1987

[54] SCUBA GEAR WITH COMBINED FLOTATION AND TRANSPORT DEVICE

[76] Inventor: William L. Courtney, 3000 Steiner St., San Francisco, Calif. 94123

[21] Appl. No.: 664,238

[22] Filed: Oct. 24, 1984

[51] Int. Cl.[4] ..... B63C 9/02

[52] U.S. Cl. ..... 441/40; 441/92; 441/96; 441/106; 405/186

[58] Field of Search ..... 405/185, 186; 441/35, 441/40–42, 106, 108, 111, 112, 114–119, 92, 96

[56] References Cited

U.S. PATENT DOCUMENTS

| | | | |
|---|---|---|---|
| 1,216,457 | 2/1917 | Jelalian | 441/114 |
| 1,410,438 | 3/1922 | Willows et al. | 441/8 |
| 2,114,301 | 4/1938 | Harrigan | 244/148 |
| 3,425,071 | 2/1969 | Frieder, et al. | 9/11 |
| 3,436,777 | 4/1969 | Greenwood | 405/186 X |
| 3,727,250 | 4/1973 | Koehn, et al. | 9/313 |
| 3,747,140 | 7/1973 | Roberts | 9/319 |
| 4,016,616 | 4/1977 | Walters | 9/339 |
| 4,176,418 | 12/1979 | Scott | 9/313 |

*Primary Examiner*—Sherman D. Basinger
*Attorney, Agent, or Firm*—John A. Bucher

[57] ABSTRACT

Scuba gear is disclosed for use by divers and the like for carrying a compressed air tank to provide an underwater source of oxygen, a backpack being adapted for securing the tank to the diver and including quick release components for permitting the diver to rapidly free himself of the tank, an inflatable transport raft being secured to the tank and held in compact and gathered form by releasable fasteners in order to permit the raft to open in response to internal inflation pressure, the backpack being adapted for connection to the diver's upper torso together with a separate vest type buoyancy compensator, the backpack being adapted to permit inflation of the buoyancy compensator if desired and also permitting separation of the tank with the buoyancy compensator remaining in place on the diver, the transport raft providing flotation for the tank when the tank is freed from the diver, the raft also providing transport for the diver on the surface of the water.

8 Claims, 4 Drawing Figures

FIGURE 2
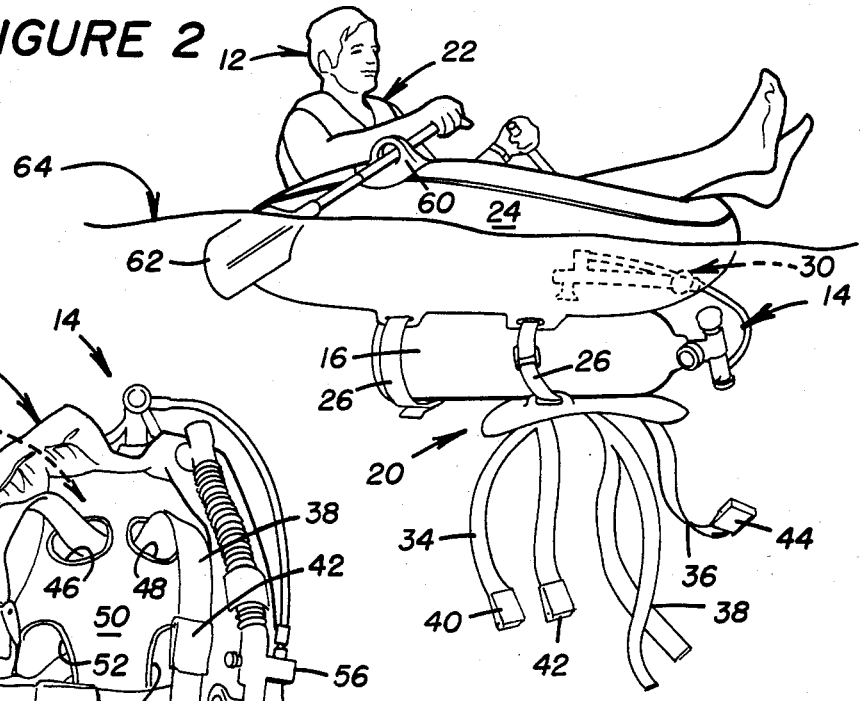
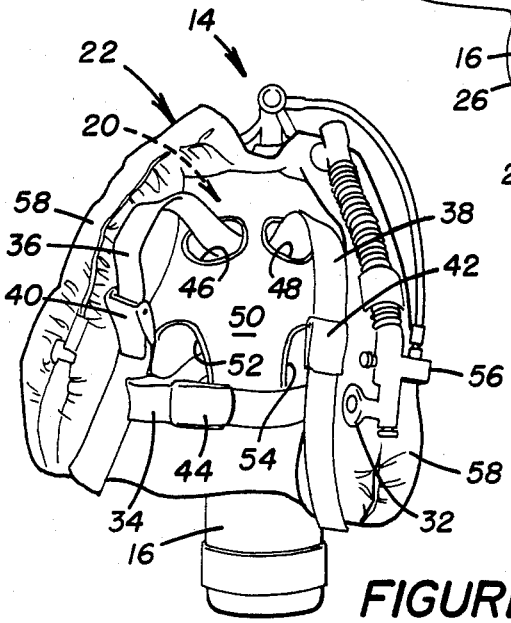
FIGURE 4
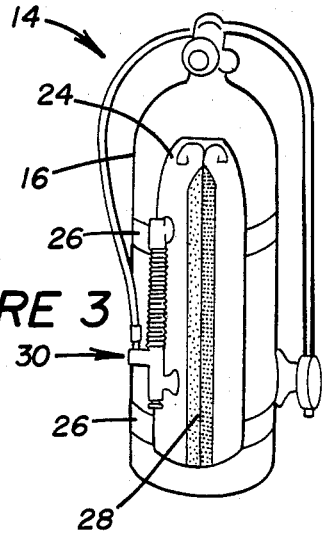
FIGURE 3
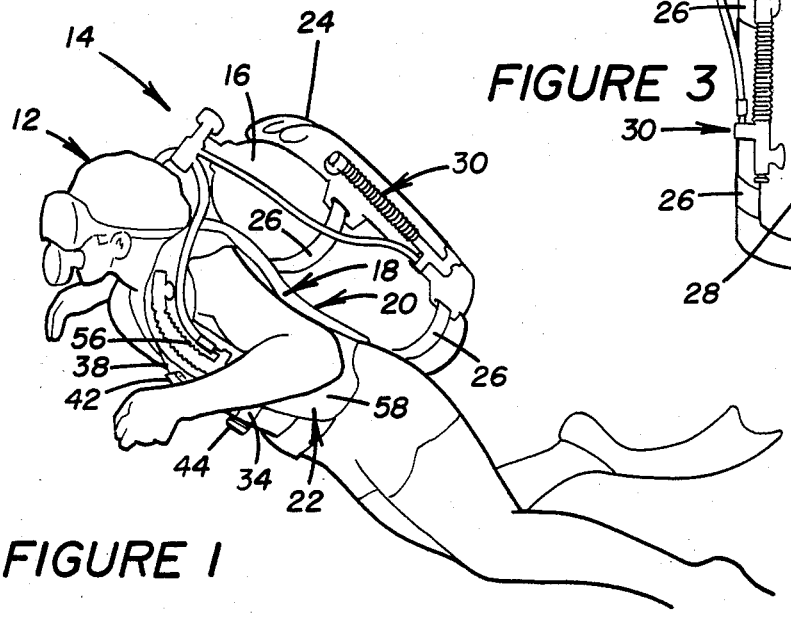
FIGURE 1

SCUBA GEAR WITH COMBINED FLOTATION AND TRANSPORT DEVICE

BACKGROUND OF THE INVENTION

The present invention relates to scuba gear and more particularly to scuba gear adapted for use by a diver to facilitate the diver's use of the gear.

Many modifications and variations of scuba gear have been provided in the prior art for facilitating use thereof by divers. Particularly in underwater situations, it is important for the diver to be able to rapidly and effectively manipulate the scuba gear either for providing an underwater source of oxygen to the diver or for permitting the diver to return to the surface, possibly under emergency circumstances. In the event that the diver desires or finds it necessary to return to the surface, the safety of the diver is of course of primary importance. However, it is of secondary importance that he be able to either keep the scuba gear with him as he returns to the surface or assure that the scuba gear will return by itself because of its relative expense.

As will also be apparent from the following description, it is often necessary for the diver to travel a relatively substantial distance either on or beneath the surface of the water in order to reach a selected diving site or to return from the diving site to the shore or to a boat or the like.

As is well known at least among those who commonly use such gear for underwater diving, the term "scuba" is an acronym for self contained underwater breathing apparatus. Scuba apparatus or gear commonly includes a tank containing compressed air in order to provide the diver with an underwater supply of oxygen. The tank is commonly mounted on the diver's upper torso or back by a suitable backpack. Scuba gear may also include a buoyancy compensator which the diver wears and can selectively inflate for various purposes.

Various combinations of such components have been described in the prior art, for example in Walters U.S. Pat. No. 4,016,616 issued Apr. 12, 1977; Scott U.S. Pat. No. 4,176,418 issued Dec. 4, 1979; and Roberts U.S. Pat. No. 3,747,140 issued July 24, 1973.

Of these references, the Scott patent disclosed apparatus of a type widely used, automatically or under diver control, for inflating scuba gear such as a buoyance compensator from the tank. Such equipment also commonly includes means for permitting the diver to manually inflate such buoyancy devices by blowing into a mouthpiece associated with the apparatus. The apparatus may also include emergency sources of compressed gas such as compressed carbon dioxide canisters or the like and may further be adapted with quick release couplings which in themselves are well known in the prior art. The Roberts patent also disclosed the use of such inflation apparatus with a quick release coupling for interconnecting a compressed air tank with a buoyancy compensator in the form of a life jacket. The life jacket disclosed in the Roberts patent is of a type fitting about the diver's neck and is sometimes referred to as a "horse collar" buoyancy compensator or life jacket.

The Walters patent disclosed similar scuba gear wherein an inflatable buoyancy compensator is secured to the compressed air tank and mounted on the diver's torso or back by the same backpack used for the tank. Through this combination, the diver can inflate the buoyancy compensator in order to adjust the effective underwater weight of the diver. As noted in the Walters patent, it is not always possible to accurately predict the amount of extra weight a diver must wear in order to achieve neutral or slightly positive buoyancy. Accordingly, life jackets or buoyancy compensators are commonly provided with inflation apparatus of the type referred to above wherein the diver can manually inflate the life jacket or buoyancy compensator as necessary in order to establish desired buoyancy.

As was further noted in the Walters patent, undesired negative buoyancy occurs for various reasons, such as when the weight of the diver changes between dives, and particularly when compression of plastic foam cells or the like in his wetsuit occurs at diving depths. In any event, because of the common backpack employed by Walters for the air tank and buoyancy compensator, the Walters buoyancy compensator was separated from the diver along with the tank and was thus no longer available as a personal safety device. Thereafter the Walters buoyancy compensator acted only as a flotation device for the tank. Thus, a diver using the Walters equipment could allow the tank to be carried to the surface by the buoyancy compensator and in an emergency could even use the combination of the buoyancy compensator and tank as a means for supporting himself on the surface of the water. However, it is again noted that the Walters buoyancy compensator would not be available to assist the diver in reaching the surface of the water and would not support the diver on the surface in rough seas or if the diver were unconscious, for example.

In addition to problems of the type referred to above and dealt with in the above patents, a diver using scuba gear of the type contemplated by the present invention can also encounter other problems. For example, in various underwater situations, it is not only necessary to provide flotation means for returning the tank and other scuba gear components to the surface but also to provide a buoyancy compensator for assisting the diver himself in returning to the surface. In the combination of the Walters patent, it is noted again that the buoyancy compensator remained permanently attached to the tank and thus was not available for assisting the diver.

Furthermore, there are numerous situations where it is important for the diver to have transport means available for removing himself from the water. For example, when a diving site is selected which is some distance from the shore or from a boat used by the diver, it is necessary for the diver to travel either along the surface of the water or under the surface of the water to the diving site and to return after completion of the dive.

Return trips of this type are sometimes difficult because the diver may be exhausted from swimming against the current, or may be suffering for example from hypothermia or even from injury resulting for example from a laceration by coral, sea urchins or jelly fish or the like. In such situations, it is accordingly important to provide transport means capable of supporting the diver out of the water, as well as to increase visibility in search and rescue efforts.

Accordingly, there has been found to remain a need for improved scuba gear capable of facilitating desired operation of the gear by the diver both underwater and on or near the surface of the water.

SUMMARY OF THE INVENTION

It is therefore an object of the invention to provide scuba gear capable of resolving one or more problems of the type referred to above in order to enhance utility of the scuba gear to the diver and to increase the diver's capabilities or enjoyment.

It is a more specific object of the invention to provide such scuba gear including a compressed air tank for providing an underwater source of air to the diver, the scuba gear further comprising backpack means for securing the tank to the diver, an inflatable transport raft suitable for being gathered in compact form and secured to the tank, releasable means holding the raft in its compact gathered form on the tank to permit the raft to be a portion of the scuba gear during underwater use by the diver.

The releasable means is preferably adapted for permitting the transport raft to open when the raft is inflated so that the transport raft provides a flotation means for the tank when the tank is separated from the diver, the raft also providing transport means for the diver on the surface of the water.

It is yet another object of the invention to provide scuba gear of the type described immediately above wherein the releasable means are adapted for allowing the transport raft to open in response to internal inflation pressure.

It is a further object of the invention to provide such scuba gear wherein the backpack means and a separate vest type buoyancy compensator are adapted for separate connection to the back or upper torso of the diver. This combination is desirable so that the buoyancy compensator remains available to the diver even after he frees himself from the tank.

With such a combination, the transport raft provides a flotation means for the tank while the diver continues to have a buoyancy compensator available for assisting his return to the surface if necessary. In such a combination, both the buoyancy compensator and raft may be provided with automatic or diver operated inflation means.

It is a yet further related object of the invention to provide such a combination wherein the vest type buoyancy compensator is of a type adapted for closely fitting about the upper torso of the diver and including a back panel attached to flotation means arranged adjacent to the diver's waist and chest.

In such a combination, openings are preferably formed in the back panel for permitting elongated straps of the back pack to be threaded therethrough and interconnected with quick release means. Even more preferably, the back panel of the buoyancy compensator is also provided with larger openings for facilitating and assuring that the relatively bulky quick release means are also permitted to separate from the buoyancy compensator and the diver when desired.

Additional objects and advantages of the invention are made apparent in the following description having reference to the accompanying drawings.

BRIEF DESCRIPTION OF THE DRAWING

In the drawings:

FIG. 1 is a pictorial representation of scuba gear constructed in accordance with the present invention and being worn by a diver under the surface of the water.

FIG. 2 is a similar pictorial representation of the scuba gear with an inflatable transport raft being secured to a compressed air tank of the gear both for providing a flotation device for the tank or tanks and also to provide transport means for carrying the diver out of the water while on the surface.

FIG. 3 is a view of a surface of the compressed air tank of the scuba gear opposite the diver in order to illustrate the transport raft being deflated and arranged in compact and gathered form upon the tank to permit it to accompany the diver during underwater use of the scuba gear.

FIG. 4 is a view of a buoyancy compensator together with a back pack for mounting the air tank described above, both the buoyancy compensator and back pack being illustrated in configurations for being positioned on the diver.

DESCRIPTION OF THE PREFERRED EMBODIMENTS

Referring now to the drawings and particularly to FIG. 1, a diver 12 is illustrated wearing scuba gear generally indicated at 14 which is constructed in accordance with the present invention. Portions of the scuba gear are also illustrated in FIGS. 2–4 as will be described in greater detail below.

Continuing with reference to FIG. 1, the scuba gear 14 comprises a compressed air tank 16 which is adapted for attachment to the diver's back or torso 18 by means of a backpack generally indicated at 20.

As is described in greater detail below, the backpack 20 is adapted for being interrelated with a vest-type buoyancy compensator 22 so that both can be secured closely about the torso 18 of the diver.

The backpack 20 and vest-type buoyancy compensator 22 are separate components, the backpack 20 serving to secure the tank 16 in place upon the diver while permitting the buoyancy compensator 22 to be inflated for conventional underwater use in order to adjust the buoyancy of the diver. At the same time, as will also be described in greater detail below, the backpack 20 and its interrelation with the buoyancy compensator 22 permits the diver to rapidly release the tank 16 and the backpack 20 by operation of quick release means described below as forming a portion of the backpack 20.

An inflatable transport raft 24 is also illustrated as being interconnected or secured to the tank 16 and backpack 20. Preferably, the raft 24 is secured to the tank 16 by straps indicated at 26.

In addition to being secured to the tank 16 by the straps 26, the transport raft 24 is maintained in compact and gathered form as illustrated in FIG. 1 by additional releasable elements 28. Preferably, the elements 28 are formed on the raft itself or on a flap extension (not shown) and extend generally the length of the folded raft as shown in FIG. 3 while being of a type including hook and loop fasteners (not shown) conventionally available under the trademark VELCRO from the Velcro Corporation. With the elements 28 being so configured, they serve to permit the raft 24 to open in response to internal pressure developed during inflation of the raft and otherwise maintain the raft as a streamlined package on the tank.

An inflation device 30 is interconnected with the raft 24. In accordance with the prior art, the inflation device 30 is of a type permitting the raft 24 to be inflated either from air pressure in the tank 16 or manually by the diver 12 blowing into a mouthpiece 32. The inflation device 30 can also be adapted, if desired, for inflating the raft 24 is desired from an emergency compressed gas source such as a compressed carbon dioxide canister which could, for example, be mounted in or on the raft 24.

Preferably, the life raft can be separated from the tank if necessary or if desired either to use the raft by itself on the surface or to permit the diver to free the raft underwater and inflate it, for example, to lift artifacts, salvage items or the like from the sea floor. Accordingly the straps 26 are preferably adapted for releasing the raft 24 from the tank 16 at the option of the diver.

The backpack 20 includes means for separate attachment about the diver's waist and shoulders. Referring also to FIG. 4 where portions of the backpack are illustrated in this regard, the backpack 20 includes elongated straps 34, 36 and 38 which are adapted for interconnection with separate quick buckles, of otherwise conventional construction, also forming a portion of the backpack 20 and being indicated respectively at 40, 42 and 44. One of the straps, for example that indicated at 34 passes about the waist of the diver and is connected for example with the quick release buckle indicated at 40. The other two elongated straps 36 and 38 pass separately about the respective shoulders of the diver 12 for interconnection with the respective quick release buckles 42 and 44.

As may be best seen in FIG. 4, the elongated shoulder straps 36 and 38 are threaded through slots or openings 46 and 48 formed toward the top of a back panel 50 of the buoyancy compensator 22. The waist strap 34 and the quick release buckles 40, 42 and 44 are threaded through larger openings 52 and 54 near the bottom of the back panel 50.

With this arrangement and with the backpack and buoyancy compensator positioned on the diver as illustrated in FIG. 1, the respective straps 34–38 may be interconnected with the quick release buckles 40–44 as shown. The buoyancy compensator 22 also includes an inflation device 56 of the same type described above for the raft and indicated at 30.

It is to be noted that, in accordance with the invention, the entire back panel of the buoyancy compensator could be open to facilitate passage of the straps and buckles as described above. However, the configuration shown here is preferred for structural integrity of the buoyancy compensator/life preserver.

In addition to the back panel 50, the buoyancy compensator 22 also includes inflatable portions 58 adapted for arrangement adjacent the diver's waist, chest and shoulders as illustrated in FIG. 1 in order to provide generally balanced buoyancy and support for the diver either under water or on the surface of the water.

As is illustrated in FIGS. 1–3, the inflatable transport raft 24 is secured to the tank 16 opposite the diver 12 so that the raft does not interfere with the diver's use of the scuba gear while under water as illustrated in FIG. 1.

The inflatable transport raft 24 itself is of conventional design and is preferably selected to permit it to form as compact a package as possible in the configuration of FIG. 1. For example, the raft may include oar locks 60 in the form of nylon loops and paddles such as that indicated at 62 to further facilitate the diver's use of the raft in either traveling to or returning from a diving site.

Preferably, the raft 24 is of double wall construction as conventionally used in buoyancy compensators. The outer wall (not shown) may be made of nylon, for example, to provide protection from abrasion, puncture, deterioration from sunlight and to prevent pressure stress on seams. The raft 24 may also be formed with multiple air compartments to provide increased security.

With scuba gear constructed in accordance with the present invention and as described above, its operation to further facilitate use of the scuba gear by the diver both under water and on the surface is believed apparent. However, use of the scuba gear in typical applications is briefly described below in order to assure a complete understanding of the invention.

Initially, as will be described in greater detail below, the diver 12 may use the raft 24 in order to reach a selected diving site if desired. In any event, once at the diving site, the scuba gear 14 is arranged in the configuration illustrated in FIG. 1. Whether the diver swims to the diving site or uses the raft, it is contemplated that he will be wearing the buoyancy compensator 22.

Once at the diving site, the diver also attaches the scuba gear including the tank 16 and the backpack 20 by interconnecting the straps 34–38 with the quick release buckles 40–44 in the manner described above and as illustrated in FIGS. 1 and 4.

If the diver uses the raft 24 for reaching the diving site, he also deflates the raft 24 and gathers it together by folding or rolling for example into the compact configuration illustrated in FIGS. 1 and 3. The quick release elements 28 are then used to maintain the raft in its compact configuration.

Thereafter, the diver continues with an underwater dive. During such a dive, he can use the inflation device 56 for the buoyancy compensator 22 in a conventional manner for helping him regulate his underwater buoyancy.

In the event that the diver wishes to return to the surface and particularly to do so unencumbered by most of the scuba gear 14, he may rapidly separate himself from the tank 16 by use of the quick release buckles 40–44. At the same time, it is noted that the inflation device 56 preferably includes a quick release coupling (not shown) interconnected with the tank 16. Accordingly, before undoing the quick release buckles 40–44 or shortly thereafter, the diver may employ the inflation device 56 for achieving a selected buoyancy effect within the compensator 22. The straps 34–38 and quick release buckles 40–44 are then separated from the buoyancy compensator through the openings 46, 48 and 52, 54.

The diver can then inflate the raft by means of the inflation device 30 either by means of the tank 16 or an emergency compressed gas source as noted above if desired. In response to development of inflation pressure within the raft, the quick release elements 28 release from each other and permit the raft to open by unfolding or unrolling. The raft 24 then serves as a flotation device for carrying the tank 16 to the surface of the water where it normally assumes the configuration illustrated in FIG. 2.

At the same time, the diver 12 retains the buoyancy compensator 22 for assisting him in arriving at the surface of the water, if necessary or desired.

Once on the surface of the water, the diver may then enter the raft 24 so that he is supported out of the water, generally indicated at 64 in FIG. 1. The diver may then use the paddle 62 in the manner described above for returning from the diving site.

As noted above, the raft can be used in a similar manner or configuration by the diver for reaching the diving site. In either event, whether he is returning from the diving site or approaching the diving site, the tank 16 and backpack 20 remains suspended beneath the raft 24 to which they are secured by the straps 26.

As may also be seen by combined reference to FIGS. 2 and 3, the inflation device 30 for the raft 24 is mounted on a lower surface of the raft 24. It is also rolled or folded into a compact configuration as illustrated in FIGS. 1 and 3 so that the inflation device 30 is readily accessible by the diver for use with the tank 16.

Accordingly, there has been disclosed a novel combination of scuba gear adapted for facilitating use of the gear by a diver both under water and on the surface of the water. Numerous modifications and variations in addition to those described above are believed apparent from the preceding description. Accordingly, the scope of the invention is defined only by the following appended claims.

What is claimed is:

1. Scuba gear for use by divers and the like for carrying a compressed air tank to provide an underwater source of air, comprising backpack means for securing the tank to the diver, said backpack means comprising quick release means for permitting the diver to rapidly free himself of the tank, a buoyancy compensator adapted for relatively close fitting engagement about the upper torso of the diver, said backpack means being adapted for firmly securing the tank on the upper torso of the diver while allowing said buoyancy compensator to be inflated and deflated on the diver, said backpack means comprising a plurality of elongated straps adapted for passage around the upper torso of the diver, said quick release means being separately connected to said backpack means for releasable engagement with said elongated straps to secure said backpack means and the tank in place upon the diver's upper torso, said elongated straps being adapted for threaded passage through said vest type buoyancy compensator in order to permit said backpack means and said tank to be readily separated from the diver and said buoyancy compensator upon operation of said quick release means, said buoyancy compensator comprising inflatable means arranged adjacent the diver's waist and chest, said buoyancy compensator further comprising a flat panel covering a portion of the diver's back and interconnected with said inflatable means for securing them in place upon the divers upper torso, said back panel being formed with openings for receiving said elongated staps of said backpack means in order to permit secure attachment of said backpack means to the upper torso of the diver, said openings in said back panel also being adapted for facilitating passage of said elongated straps therethrough to facilitate freeing the diver from the tank and said backpack, an inflatable transport raft suitable for supporting the diver out of the water, means for securing said transport raft to the tank, means operable by the diver for inflating said transport raft, and releasable means for maintaining said transport raft in compact and gathered form on the tank when deflated in order to facilitate the diver's underwater use of the tank with said deflated transport raft secured thereto, said releasable means being operable for allowing said transport raft to open as it is inflated, said transport raft thereupon proving flotation means for the tank when said quick release means is operated for freeing the tank from the diver, said inflated transport raft also providing transport means for the diver on the surface of the water.

2. The scuba gear of claim 1 wherein said quick release means are relatively bulky and said buoyancy compensator further comprises enlarged opening means permitting said quick release means to be passed therethrough for engagement with said elongated straps, said enlarged openings also facilitating passage of said quick release means therethrough in order to facilitate freeing of the tank and said backpack means from the diver.

3. The scuba gear of claim 2 wherein said backpack means comprises a harness assembly including elongated straps and corresponding quick release means for passage respectively about the waist and both shoulders of the diver.

4. Scuba gear for use by divers for carrying a compressed air tank to provide an underwater source of air, comprising, a buoyancy compensator adapted for relatively close fitting engagement about the upper torso of the diver, backpack means comprising quick release means for selectively securing the tank on the upper torso of the diver independently of the buoyancy compensator while permitting the diver to rapidly free himself of the tank, said backpack means comprising a plurality of elongated straps adapted for passage around the upper torso of the diver, said quick release means being separately connected to said backpack means for releasable engagement with said elongated straps to secure said backpack means and the tank in place upon the diver's upper torso and to permit said backpack means and said tank to be readily separated from the diver and said buoyancy compensator, an inflatable transport raft comprising means for supporting the diver out of the water, means for securing said transport raft to the tank or backpack means, means operable by the diver for inflating said transport raft, and releasable means for maintaining said transport raft in compact and gathered form on the tank when deflated in order to facilitate the diver's underwater use of the tank with said deflated transport raft secured thereto, said releasable means being operable for allowing said transport raft to open as it is inflated, said transport raft thereupon providing flotation means for the tank when said quick release means is operated for freeing the tank from the diver, said inflated transport raft also providing transport means for the diver on the surface of the water, said buoyancy compensator remaining in place on the diver to assist him in returning to the surface of the water after being separated from said backpack means and the tank.

5. The scuba gear of claim 4 wherein said means for securing said transport raft to the tank is adapted for positioning said transport raft on the tank so that said transport raft does not impede underwater use of the tank by the diver.

6. The scuba gear of claim 4 wherein said means for securing said raft on the tank are releasable for freeing said raft from the tank.

7. The scuba gear of claim 4 further comprising means operable by the diver for selectively regulating inflation of said buoyancy compensator and said transport raft.

8. The scuba gear of claim 7 wherein said inflation regulating means are also adapted for selectively inflating said buoyancy compensator and said transport raft from an emergency source of compressed gas.

* * * * *